US008231149B1

(12) United States Patent
Shelby

(10) Patent No.: US 8,231,149 B1
(45) Date of Patent: Jul. 31, 2012

(54) ADJUSTABLE VEHICLE HOOD LATCHING APPARATUS AND METHOD

(75) Inventor: Carroll Hall Shelby, Los Angeles, CA (US)

(73) Assignee: Shelby American, Inc., Gardena, CA (US)

( * ) Notice: Subject to any disclaimer, the term of this patent is extended or adjusted under 35 U.S.C. 154(b) by 949 days.

(21) Appl. No.: 12/217,823

(22) Filed: Jul. 9, 2008

(51) Int. Cl.
*E05C 5/02* (2006.01)

(52) U.S. Cl. ..... 292/59; 292/202

(58) Field of Classification Search ..... 292/57–59, 292/109, 116, 300, DIG. 14, DIG. 31, 202; 411/549, 550, 555; 70/240
See application file for complete search history.

(56) References Cited

U.S. PATENT DOCUMENTS

| | | | | |
|---|---|---|---|---|
| 1,448,836 | A | 3/1923 | Fisher | |
| 1,570,281 | A | 1/1926 | Raymond | |
| 2,110,435 | A | 3/1938 | Albin | |
| 3,207,543 | A * | 9/1965 | Boyer | 292/52 |
| 3,415,086 | A * | 12/1968 | Trainor | 70/240 |
| 3,585,824 | A | 6/1971 | Schenk | |
| 3,600,018 | A * | 8/1971 | Dzus et al. | 292/69 |
| 3,633,390 | A | 1/1972 | Wartian | |
| 3,874,041 | A | 4/1975 | Smith | |
| 4,308,646 | A | 1/1982 | Schenk | |
| 4,988,065 | A | 1/1991 | Leban et al. | |
| 5,585,151 | A | 12/1996 | Bruning | |
| 6,254,150 | B1 * | 7/2001 | Hornemann et al. | 292/341.18 |
| 6,394,211 | B1 * | 5/2002 | Palenchar et al. | 180/69.21 |

* cited by examiner

*Primary Examiner* — Gary Estremsky
(74) *Attorney, Agent, or Firm* — Don B. Finkelstein

(57) ABSTRACT

A latching apparatus is disclosed. In one embodiment, the apparatus comprises a first assembly disposed on a first portion of a vehicle. A second assembly is disposed on a second portion of the vehicle and configured to detachably attach with the first assembly. The second assembly includes an adjustment mechanism to prevent damage upon the first assembly detected in an undesirable orientation during insertion therein.

14 Claims, 5 Drawing Sheets

ADJUSTABLE VEHICLE HOOD LATCHING APPARATUS AND METHOD

BACKGROUND OF THE INVENTION

1. Field of the Invention

The invention relates generally to the field of latch assemblies, and specifically in one exemplary aspect to an automobile hood latch.

2. Description of Related Technology

Latch assemblies are well known in the art. Such latch assemblies are used to join together two or more members. Latch assemblies may be utilized to fasten a swinging closure or cover to a closed position. In one example, swinging cover or wall of the hood encloses the engine of a motor vehicle. Some related art patents discussed below (and incorporated by reference in their entirety) are representative art of conventional latch assemblies.

U.S. Pat. No. 1,488,836 discloses a pin-tumbler lock operable only by a key adapted to the form and arrangement of the usual series of pin-tumblers included in the lock mechanism. U.S. Pat. No. 3,585,824 includes a fastener element provided with spiral cam slots for engaging a spring attached to one of its members. More specifically, when the fastener element is axially rotated, a spring is urged into the cam slots to fasten the spring and element together. Further in this example, fastening elements are inventoried of varying lengths to adjust a length of the fastener element for accommodating a fastening distance between members. U.S. Pat. No. 2,110,435 discloses a latching structure with an opening to receive a cam structure and with a curved plate latching means.

Other examples include U.S. Pat. No. 3,633,390 disclosing a key-operated latch mechanism adapted for reception and latching of that portion of a latch pin extending beyond the hood pin to the end of the device to prevent unauthorized removal of the latch pin; and U.S. Pat. No. 1,570,281 discloses fastening means whereby two head fasteners on a suitable fold of a curtain are maintained through eyelets of the fasteners or studs so as to facilitate the opening and the closed operation of the fasteners. In another example, U.S. Pat. No. 4,308,646 discloses a receptacle including a housing formed with a base and a pair of opposing spaced legs adapted to receive a stud there between. A stop surface is on the housing to engage with an upper surface of one member when the receptacle is partially extended through an opening therein.

In many instances, latch structure may further be desired to achieve still wider variety of fastening options and give improved adaptability of a fastener to a variety of surfaces and opening sizes and types without the need for multiple fasteners as well as improved outward appearance of the fastened element. For instance, a fastener needs to blend into, augment, or conform to a surrounds of the members that it attaches to improve outward appearance of the attached article. In this same instance, a manufacturer or user may find it beneficial that an off-the-shelf fastener gives an appearance of a customized fit, e.g., in an open position, the fastener does not extend, dangle, or hang from the members that it's attached. Furthermore, a user may further desire that a fastener that is off-the-shelf provides a catch mechanism to prevent wrong orientation when being placed in a closed position but still remain relatively low cost and reusable. In addition, a manufacturer may further desire that the fasteners don't cause significant wear on painted surfaces when in use.

Thus, what is needed are improved fastener apparatus and methods that permit easy initial configuring and reconfiguring, i.e., provide adaptability to multiple situations, to meet a particular goal, such as fasteners don't dangle on a hood surface when unlocked or require lanyards. Such improved apparatus and methods would also ideally allow a person other than a mechanic or mechanical servicing professional to implement or attach the improved fastener, and would further permit the creation of user-customized fasteners configurations and customized fit and appearance such as through the use of fastener internal adjustment mechanisms.

SUMMARY OF THE INVENTION

In a first aspect of the invention, an apparatus is disclosed capable of preventing damage when assemblies of the apparatus are misaligned. In one embodiment, the apparatus comprises a first assembly and a second assembly. The first assembly is disposed on a first portion of a vehicle. The second assembly disposed on a second portion of the vehicle and configured to detachably attach with the first assembly. The second assembly comprises an adjustment mechanism to prevent damage upon the first assembly being detected in an undesirable orientation during insertion therein.

In a second aspect of the invention, an adjustable locking structure is disclosed for a hood of a vehicle. A twist lock handle integrates into a surface of the hood. In one embodiment, the handle may mate with a slotted opening in a bracket located on a structure of the vehicle. In another embodiment, the twist lock handle mounts orthogonal to the surface of the hood. A bushing is proximal to the surface of the hood and operatively connects to the twist lock handle to limit range of motion of the twist lock handle. In one example, bushing limits range of motion to substantially a quarter turn range of motion. In another example, detents in the twist lock handle prevent motion until an active force rotates the handle. In another embodiment, a keyed hood pin may include an incremental height adjustment mechanism to prevent pin misalignment and adjust an operational height of the keyed hood pin. A keyed structure may operatively connect to the keyed hood pin to prevent damage of the slotted opening in the bracket upon the hood being swung from at least a partially opened position to a substantially closed position.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and Combinations particularly pointed out in the appended claims.

DETAILED DESCRIPTION

Reference is now made to the drawings wherein like numerals refer to like parts throughout.

Overview

In one salient aspect, the present invention discloses apparatus and methods for a latching apparatus of a hood for, inter alia, locking purposes as well as aesthetics to look like, in one variant, the twist lock of the 1968 Mustang Hood Pins. In particular, the present invention discloses an apparatus and method that may be configured using one adjustable latching apparatus for multiple configuration requirements, e.g., hood height, hood depth, hood body styles, and the like. Furthermore, the present invention discloses a technique to prevent dangling, for example, of an unsecured or unlocked latching apparatus. In addition, the present invention further discloses a structure that prevents damage to the latching apparatus if it is in a locked position when the hood hinges (due to the hood closing) rotates from a open position to a closed position, e.g., to contact a portion of the vehicle, e.g., slots in a support bracket of the vehicle.

In addition, the latching apparatus provides for securely maintaining a locking position until an active force is applied when, e.g., a handle is turned. In addition, the latching apparatus of the present invention prevents wear of a painted surface by, e.g., using bushings that are keyed into the hood. Thus, the apparatus advantageously allows multiple configuration styles and supports many different system configurations through its ability to provide to a user significant flexibility of rapid adjustment to create new "customized" fit.

Exemplary Extension Apparatus

Referring now to FIGS. 1-11, exemplary embodiments of the latching apparatus of the invention are described in detail. It will be appreciated that while described primarily in the context of a hood latching apparatus, at least portions of the apparatus and methods described herein may be used in other applications, such as for example and without limitation vehicles such as trucks, motorcycles, boats, trains, planes, or other applications, such as storage sheds and the like. Moreover, it will be recognized that the present invention may find utility beyond purely latching concerns. For example, the "latching apparatus" described subsequently herein may conceivably be replaced with sections or components having other functionality; e.g., helping reduce strain, stress, loading, tension, and support housings and cases for computer systems, etc. A myriad other functions will be recognized by those of ordinary skill in the art given the present disclosure.

Figure 1:
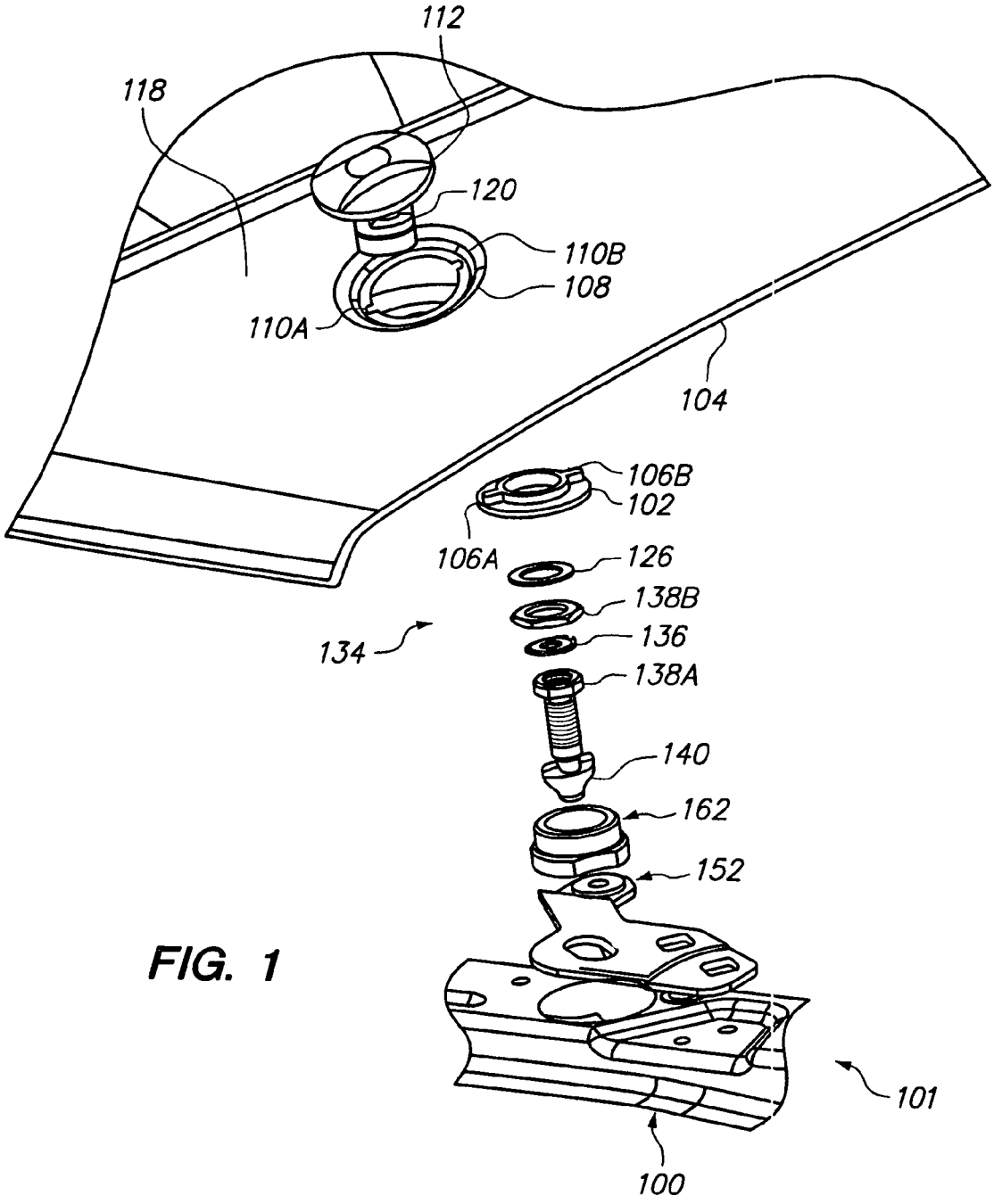
FIG. 1 is a front prospective exploded view of a portion of a hood of an automobile showing attachment of a latching mechanism in accordance with an embodiment of the present invention.

Referring to FIGS. 1-11, latching apparatus 100 of vehicle 101 includes inner hood bushing 102 that attaches to hood surface 104 (as shown in FIG. 1). Inner hood bushing 102 includes, for example, projection members 106*a*, 106*b* (e.g., fasteners) that couple to hood surface 104. Outer hood bushing 108 includes one or more slotted members 110*a*, 110*b* (e.g., fasteners) to mate with one or more projection members 106*a*, 106*b* of inner hood bushing 102 when turned by twist handle 112. Twist handle 112 couples to busing 114, e.g., u-shaped busing, through pivot pin 116, to allow twist handle 112 to rest orthogonal to hood outer surface 118 of hood surface 104. Advantageously, the present invention implementation of pivot pin 116 permits customized "contour fitted" twist handle 112 at an angle in accordance with the contour of outer hood surface 118. Thus, this invention allows a manufacturer) or after market-user) to achieve a customized fit for the twist handle 112 for a multitude of hood shape requirements in contrast to conventional, fixed surface attachment, hood ornaments or pins.

Figure 2:
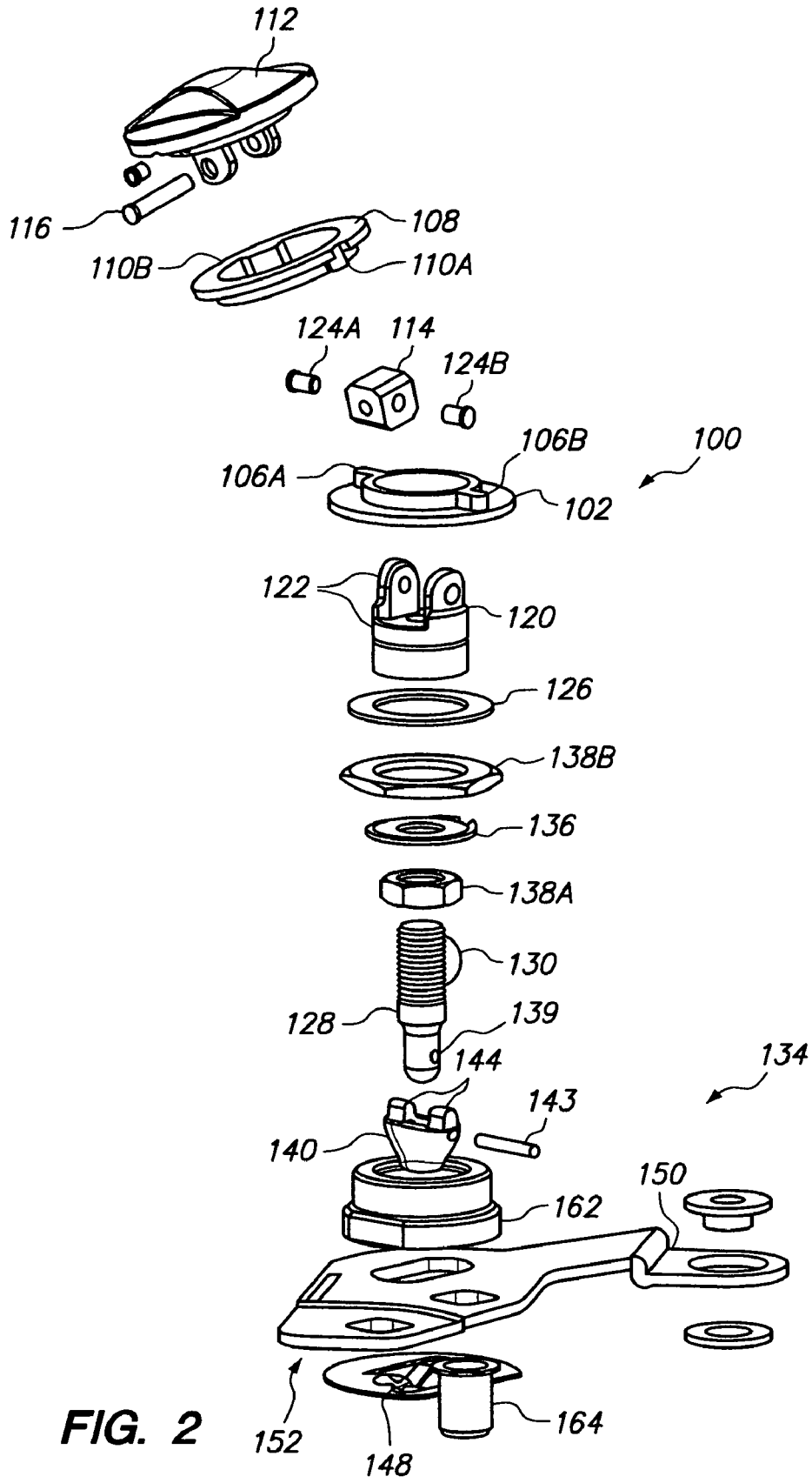
FIG. 2 is a side elevation view of a latching apparatus in accordance with an embodiment of the present invention.

Furthermore, as shown, for instance, in FIG. 2, twist handle 112 couples to inner hood bushing 102 through bushing 114. By rotating twist handle 112, inner hood bushing 102 rotates about outer hood bushing 108 and detachably locks when mating structures, e.g., 106*a*, 106*b* of inner hood bushing 102 and 110*a*, 110*b* of outer hood bushing 108 interlock. Advantageously, the inner hood bushing 102 and outer hood bushing 108 rotate on connecting surfaces, thus, paint on a hood surface is not contacted (preserved) even when the twist handle 112 is rotated as compared to conventional, hold down hood apparatuses (not shown) contact a painted or chrome surface of vehicle 101 upon rotation.

Figure 3:
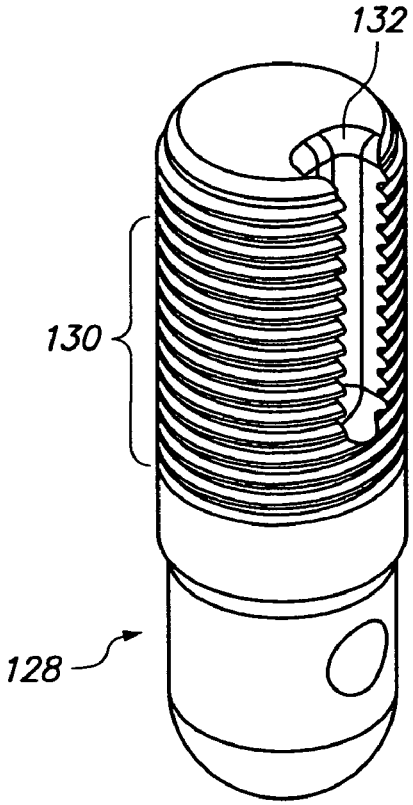
FIG. 3 is a perspective view of a hood pin in accordance with an embodiment of the present invention.
Figure 4:
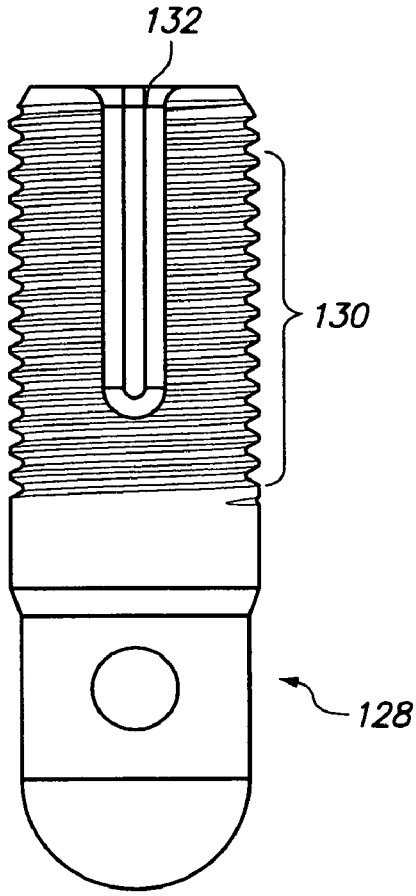
FIG. 4 is a side elevation view of a hood pin in accordance with an embodiment of the present invention.
Figure 5:
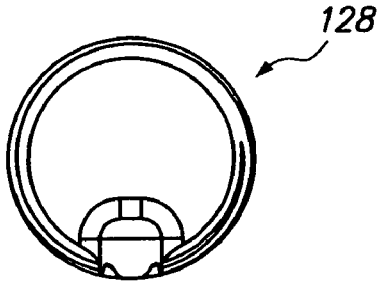
FIG. 5 is a top view of a hood pin in accordance with an embodiment of the present invention.
Figure 7:
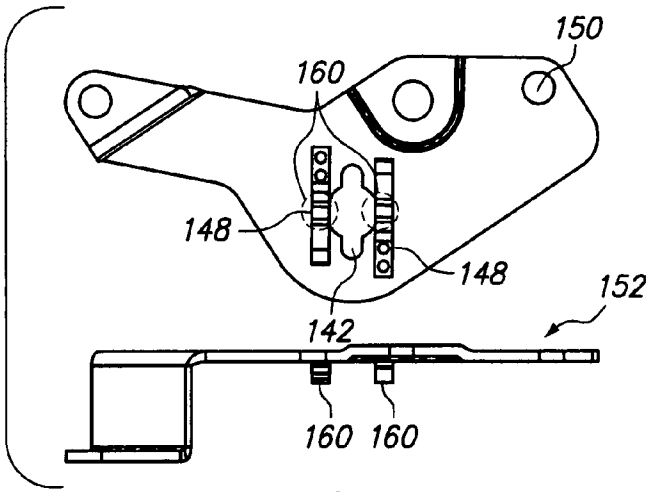
FIG. 7 is a rear elevation view of a passenger bracket in accordance with an embodiment of the present invention.
Figure 6:
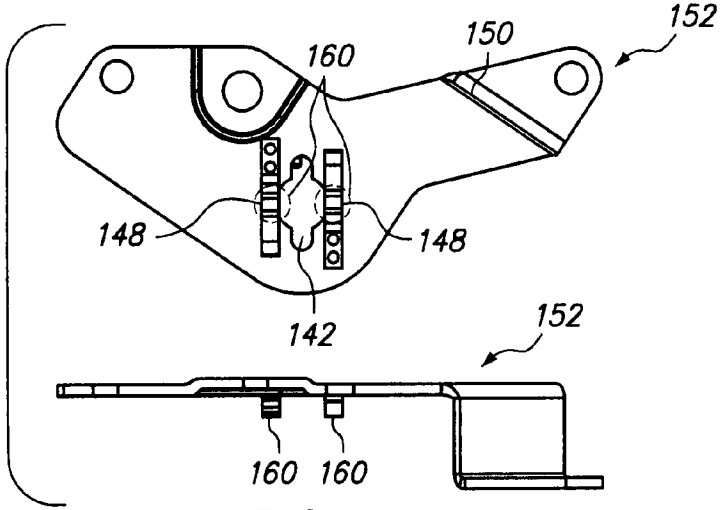
FIG. 6 is a rear elevation view of a driver bracket in accordance with an embodiment of the present invention.
Figure 11:
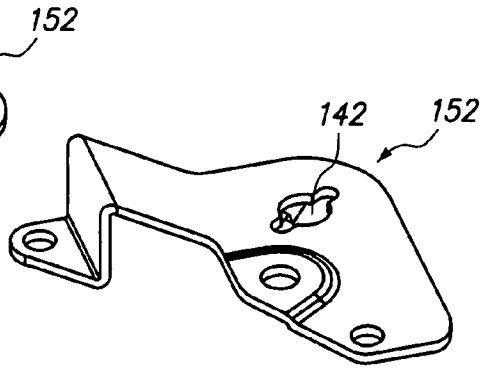
FIG. 11 is a top perspective view of a passenger's bracket in accordance with an embodiment of the present invention.
Figure 10:
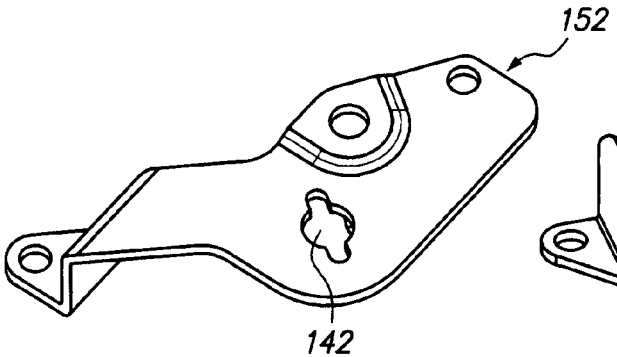
FIG. 10 is a top perspective view of a driver's bracket in accordance with an embodiment of the present invention.
Figure 9:
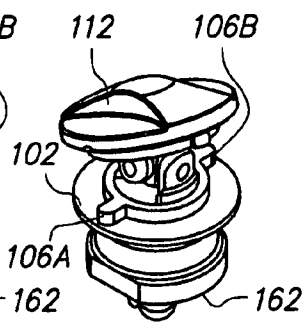
FIG. 9 is a perspective view of a latching apparatus for a passenger's bracket in accordance with an embodiment of the present invention.
Figure 8:
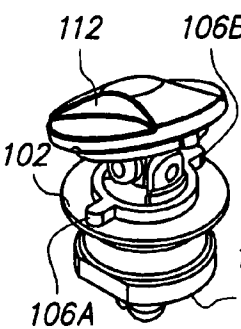
FIG. 8 is a perspective view of a latching apparatus for a driver's bracket in accordance with an embodiment of the present invention.

As shown, for instance, in FIG. 2, pin receiver 120 comprises cam structure 122 operatively connected to bushing 114 though pins 124*a*, 124*b*. In one embodiment, pins 124*a*, 124*b* are advantageously orthogonally positioned to that of pivot pin 116 to allow independent spatial alignment and adjustment of twist handle 112 and height adjustment and locking capability of the hood pin 128. The height adjustment and locking capability of the hood pin 128 are described below. In one variant, c-clip retainer 126 inserts between inner hood bushing 102 to couple with cam structure 122. Hood pin 128, in one embodiment, as shown in FIGS. 3-5, includes threads 130, and a variant of the present embodiment, a hood pin alignment slot 132, to provide a height adjustment (e.g., strike length) of latching apparatus 100. To adjust strike length of the first latching assembly 134, retaining washer 136, and retaining clip 135 may be advantageously rotated about threads 130 and jam nuts 138*a*, 138*b* (to provide a dual-securement opportunity) to secure a desired height adjustment. In contrast to the present invention, conventional systems may require a different hood pin for each type, system, or configuration of attachment process. Thus, this invention advantageously, in contrast to fixed height pin conventional systems, provides, in many instances and situations, a one-size fits all latching capability.

Advantageously, in one embodiment, the present invention provides hood pin alignment slot 132 to provide an equal increment, hood pin adjustment feature. More specifically, hood pin alignment slot 132 allows only complete turn rotation, e.g., 360 turn alignment, of hood pin 128 in comparison to conventional systems requiring manual or crude adjustment of the hood pin height, which may result in hood pin misalignment or misorientation of, for example, latching apparatus 100. For instance, using conventional non-complete revolution hood adjustment, keyed structure 140 may be misaligned with slot structure 142 and cause keyed structure 140 to strike slot structure 142 in a misaligned orientation (possibly damaging slot structure 142 or keyed structure 140) when a hood swings toward a closed position (e.g., locked position).

Keyed structure 140 operatively couples to hood pin 128 using pin 143 through hole 139 to cam pin retainer 144. In one variant, keyed structure 140 includes a radial area structure to limit range of motion of the twist handle 112. In one embodiment, range of motion of the twist handle 112 is approximately 45 degrees. In one variant of second latching assembly 152, as shown in FIGS. 6-11, spring retention clips 148 (e.g., leaf springs) attached to bracket 150 further secure keyed structure 140 to vehicle 101. In another variant, sides of slot structure 142 are chamfered to further restrict (e.g., lock) keyed structure 140 to bracket 150. Advantageously, if hood pin 128 rotates to a locked position and hood is slammed shut, keyed structure 140 contacts a portion of bracket 150 or misaligned with slot structure 142 rotates away using cam pin retainer 144; thus, this feature prevent damage to latching apparatus 100 during misorientation (or misalignment). In addition, as part of bracket on vehicle, spring retention clips 148 includes clip protrusion 160 that flexes in and out to lock and unlock keyed structure 140 when twist handle 112 is rotated. Furthermore, core support mount 164 may align or secure bumper hood pin 162 to provide an entry slot for keyed structure 140.

Exemplary Methods

Figure 12:
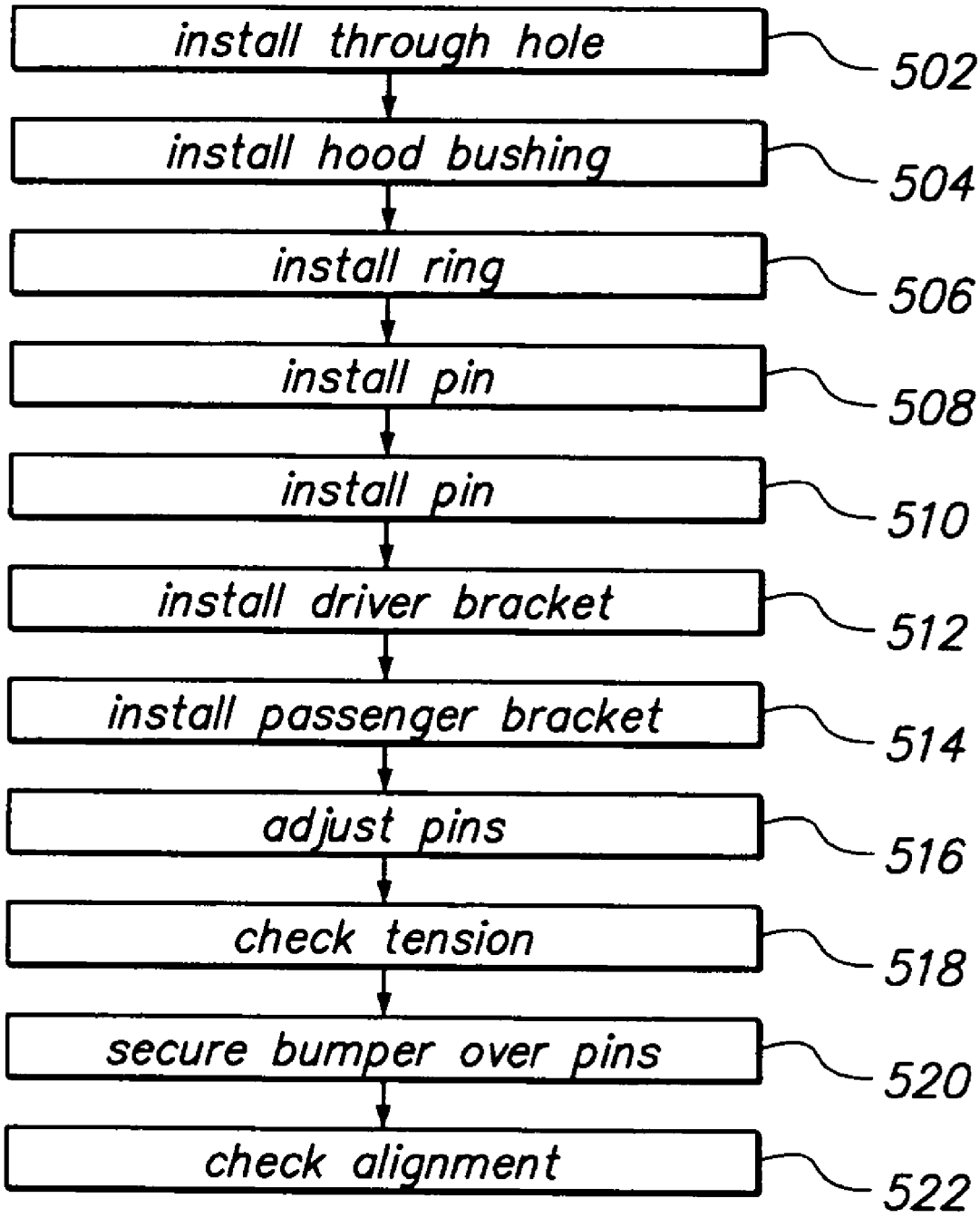
FIG. 12 is a logical flow diagram illustrating one exemplary embodiment of a method for assembling the latching apparatus in accordance with the present invention.

Referring now to FIG. 12, an exemplary embodiment of the method for fabricating the aforementioned latching apparatus is described. While described primarily in the context of the exemplary embodiments of apparatus 100 shown in FIGS. 1-11, it will be appreciated that the methodology presented herein may be readily adapted to any different configuration of apparatus 100 by those of ordinary skill.

In step 502, with hood open, install assembly threw hole in top of hood. In step 504, install inner hood bushing. In step 506, install retaining snap ring. In step 508, install pin assembly including screwing in pin assembly until it bottoms out, unscrew roughly two turns until retaining washer legs lines up with notch in shaft retainer, and push up the retaining washer and tighten jam nut(s).

In step 510, install opposite side hood pin assembly top hood inner bushing to a hood surface. In step 512, install driver retainer bracket assembly by installing bracket onto core support. In step 514, install passenger bracket assembly by installing bracket onto core support.

In step 516, adjust pins to proper tension in the retaining brackets by with hood closed, attempting to lock pins by rotating handle clockwise a quarter turn into the detent of bracket leaf springs. If pin is adjusted too long, it will not engage bracket leaf springs, and if too short it will interfere with bracket not allowing handle to turn.

In step 518, if proper tension is not achieved, unlock handles and open hood to adjust pin. In this step, adjust pin by loosing jam nut(s) enough so that retaining washer drops down enough to clear notch in pin retainer. In addition, if necessary, rotate counterclockwise to lengthen and clockwise to shorten. In one variant, 360 increments can be produced in order to retain washing leg notch in pin retainer. Once necessary adjustment is made, push up retaining washer so it's leg drops into notch of pin retainer. Tighten jam nut(s). Repeat step 518 until proper tension is achieved and pin locks securely in detent of leaf springs.

In step 520, locate bumpers removed from twist lock assembly and screw bumper over pin and onto outside diameter of retaining washer as far as it goes. In step 522, close hood, lock pins, and check alignment of fender to hood. Push on corner of hood to check deflection and unlock hood and readjust bumper until fender and hood alignment is achieved.

It will be appreciated that while certain aspects of the invention have been described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An apparatus comprising:

a first assembly disposed on a first portion of a vehicle, said first assembly further comprising a rotating handle encapsulated in a hood surface of the vehicle; and a second assembly disposed on a second portion of the vehicle and configured to detachably attach with the first assembly, the second assembly comprising:

an adjustment mechanism to prevent damage upon the first assembly detected in an undesirable orientation during insertion therein, and, spring retention clips disposed about a slotted retention member, to prevent motion of the first and second assemblies while in a locked position and to limit motion of the first and second assemblies and to limit motion of the rotating handle to a manufacturers specified radial angle.

2. The apparatus of claim 1, wherein the first assembly further comprises a limited rotationally mounted member configured to lock and unlock with the second assembly.

3. The apparatus of claim 1, wherein the first assembly further comprises a pivotally mounted handle to maintain substantially orthogonal contact with a hood surface of the vehicle and capable of lock or unlock positions and the adjustment mechanism comprises an integral hood catch member to maintain contact of the first member and the second member in the unlock position.

4. The apparatus of claim 1, wherein the first assembly further comprises a handle disposed substantially perpendicular to a hood surface of the vehicle and the second assembly further comprises a u-shaped member to detachably connect with the handle.

5. The apparatus of claim 1 wherein the manufacturer specified radial angle comprises approximately a quarter turn radial angle to provide a catch mechanism to prevent misaligned positional attachment of the rotating handle and the second assembly.

6. The apparatus of claim 1 wherein the rotating handle comprises a pin keyed with a retaining washer to limit height adjustment increments of the rotating handle.

7. An aftermarket mechanism to lock a portion of a hood surface to a portion of the vehicle comprising:

a first top head bushing;

a hood pin operatively connected to the first top head bushing, the hood pin operatively attached to a keyed member;

a pivotally mounted twist lock handle having a second top head bushing adapted to be disposed substantially orthogonal to the portion of the hood surface and operatively connected therein to rotate the hood pin in a substantially limited angular range of motion and to resist loosening of the pivotally mounted twist lock handle until application of an active force to the hood, the pivotally mounted twist lock handle encapsulated within the hood surface to prevent dangling of the pivotally mounted twist lock handle when the pivotally mounted twist lock handle is in an unlocked position; and spring retention clips substantially aligned with and detachably connected to the hood pin through a slot structure in a bracket, and the slot structure comprises a mating slotted opening to detachably attach to the keyed member.

8. The aftermarket mechanism of claim 7, further comprising a retaining washer, wherein the hood pin comprises a chamfered construction slotted along a portion of the hood pin and operatively connected to the retaining washer to provide a substantial equal increment adjustment mechanism to maintain pin alignment during alignment of the hood pin with the spring retention clips.

9. The aftermarket mechanism of claim 7 wherein the spring retention clips further comprise clip protrusions, and detents that couple to the hood pin in a locked position to prevent the keyed member from loosening from the spring retention clips during vehicle motion.

10. The aftermarket mechanism of claim 7, further comprising a cam structure operatively connected to the hood pin and the keyed structure to an unlock position from the lock position upon detection of the hood pin being in the locked position when the hood is placed in a closed position.

11. The aftermarket mechanism of claim 7, wherein the pivotally mounted twist lock handle comprises a bushing with mating radial keyways to limit handle movement when operatively connected to the spring retention clips to approximately a quarter-turn range of motion.

12. The aftermarket mechanism of claim 7, wherein the spring retention clips are adapted to be mounted orthogonally to a vehicle radiator support structure and the vehicle radiator support structure comprises a u-joint structure.

13. The aftermarket mechanism of claim 7, wherein the spring retention member further comprises the bracket and further comprising:

leaf spring proximately located about a perimeter of the slot structure in the bracket; wherein the keyed member is pivotally mounted to the hood pin to prevent damage of the bracket, spring retention clips and clip protrusions upon the hood pin in a locked position when the hood hinge swings to a closed position.

14. An adjustable locking structure for a hood of a vehicle comprising:

a twist lock handle integrated into a surface of the hood configured to mate with a slotted opening in a bracket located on a structure of the vehicle; wherein the twist lock handle is mounted orthogonal to the surface of the hood;

a bushing proximal to the surface of the hood and operatively connected to the twist lock handle to limit the range of motion of the twist lock handle to substantially a quarter turn range of motion and to degtent into the twist lock handle to prevent motion until an active force rotates the handle;

a keyed hood pin having a threaded outer surface comprising an incremental height adjustment mechanism to prevent pin misalignment and adjust an operational height of the keyed hood pin;

a retaining washer and a securing jam for choosing and securing the height adjustment of the keyed hood pin;

a keyed structure operatively connected to the keyed hood pin through a cam rotating pin to prevent damage of the slotted opening in the bracket upon the hood being swung from at least a partially opened position to a substantially closed position.

* * * * *